US011022413B1

(12) United States Patent
Broderick

(10) Patent No.: US 11,022,413 B1
(45) Date of Patent: Jun. 1, 2021

(54) ARROW INSERT WITH REINFORCING COLLAR

(71) Applicant: Day Six, LLC, Cheyenne, WY (US)

(72) Inventor: James Bryan Broderick, Fairhope, AL (US)

(73) Assignee: Day Six, LLC, Cheyenne, WY (US)

( * ) Notice: Subject to any disclaimer, the term of this patent is extended or adjusted under 35 U.S.C. 154(b) by 0 days.

(21) Appl. No.: 16/781,399

(22) Filed: Feb. 4, 2020

Related U.S. Application Data

(60) Provisional application No. 62/801,035, filed on Feb. 4, 2019.

(51) Int. Cl.
*F42B 6/08* (2006.01)
*F42B 6/04* (2006.01)

(52) U.S. Cl.
CPC . *F42B 6/08* (2013.01); *F42B 6/04* (2013.01)

(58) Field of Classification Search
CPC ..... F42B 6/08
See application file for complete search history.

(56) References Cited

U.S. PATENT DOCUMENTS

| | | | | |
|---|---|---|---|---|
| 3,868,114 | A | 2/1975 | Groner | |
| 5,496,043 | A | 3/1996 | Ester | |
| 8,460,134 | B2 * | 6/2013 | Palomaki | F42B 6/08 473/582 |
| 9,366,510 | B1 | 6/2016 | Zobell | |
| 9,638,499 | B2 | 5/2017 | Perry | |
| 9,658,036 | B2 | 5/2017 | Zobell | |
| 9,739,581 | B2 | 8/2017 | Zobell | |
| 9,772,169 | B2 * | 9/2017 | Greenwood | F42B 6/04 |
| 10,203,185 | B1 * | 2/2019 | Kitts | F42B 6/04 |
| 2004/0048704 | A1 | 3/2004 | Arasmith | |
| 2005/0075203 | A1 | 4/2005 | Palomaki et al. | |
| 2009/0075766 | A1 | 3/2009 | Ben et al. | |
| 2017/0299353 | A1 * | 10/2017 | Greenwood | F42B 6/04 |

FOREIGN PATENT DOCUMENTS

JP 2014074527 A 4/2014

OTHER PUBLICATIONS

Image of Zelor Arrows. Instagram post by @australianbowhuntingmedia. Dated Jun. 21, 2015. Via: https://www.instagram.com/p/4Nky18C7ts/?utm_source=ig_web_ button_ share_ sheet.

* cited by examiner

*Primary Examiner* — John A Ricci
(74) *Attorney, Agent, or Firm* — Larry E. Henneman, Jr.; Henneman & Associates, PLC

(57) ABSTRACT

An example assembly includes an insert and a sleeve. The insert has a first end and a second end. The first end of the insert is configured to be inserted into an end of the arrow shaft, and the second end of the insert is configured to receive a securing/anchoring end of the arrow tip. The sleeve is configured to surround at least a portion of the end of the arrow shaft and at least a portion of the insert. The insert includes an engagement mechanism, and the sleeve includes a complementary engagement mechanism. The engagement mechanism and the complementary engagement mechanism are configured to selectively engage one another.

40 Claims, 9 Drawing Sheets

ARROW INSERT WITH REINFORCING COLLAR

RELATED APPLICATIONS

This application claims the benefit of priority of U.S. Provisional Patent Application No. 62/801,035, filed on Feb. 4, 2019 by the same inventor, which is incorporated herein by reference in its entirety.

BACKGROUND OF THE INVENTION

Field of the Invention

This invention relates generally to archery, and more particularly to arrow insert/outsert assemblies.

Description of the Background Art

The demand for small-diameter arrow shafts is increasing in the archery industry. One advantage to small-diameter arrow shafts is that they have less exterior surface area. As a result, they experience less air drag and are, therefore, less affected by crosswinds during flight. Not only does mitigating air drag during flight result in more accurate shot placement, it also preserves more of the initial kinetic energy during flight. As a result, small-diameter arrows achieve higher velocities upon impacting the target. The reduced outer diameter also allows the arrow shaft to have a thicker and, therefore, stronger sidewall.

Although there are several advantages to small-diameter arrow shafts, there are also drawbacks. For example, the inside diameter of a small-diameter arrow shaft is not large enough to accept a standard arrow insert. As a result, special insert/outsert assemblies have to be used to fix arrowheads (e.g., target heads, broadheads, etc.) to small-diameter arrow shafts.

One prior art insert/outsert assembly, U.S. Pat. No. 9,638,499 (Perry), discloses an insert/outsert assembly including an insert coupled to an outsert. The insert includes a first end adapted to be adhered to the interior wall of an arrow shaft and a second end adapted to thread into the outsert. The outsert includes a first threaded end and a second threaded end. The first threaded end of the outsert is adapted to thread onto the second end of the insert. The second threaded end of the outsert includes a threaded bore (female threads) configured to receive complimentary male threads of an arrowhead.

For proper arrow flight, it is important that the arrowhead is coaxially aligned with the shaft of the arrow within some predetermined acceptable tolerance. Of course, such tolerances are dictated by a number of design, material, and manufacturing limitations. For example, in the insert/outsert assembly of Perry, the alignment of the arrowhead with respect the arrow shaft is dictated by a tolerance stack-up. This tolerance stack-up includes the alignment tolerance between the insert and the interior of the arrow shaft, the alignment tolerance between the outsert and the insert, and the alignment tolerance between the arrowhead and the outsert. Indeed, the tolerances become increasingly more strict and hard to achieve as the number of tolerances in the stack-up increases.

SUMMARY

What is needed is an insert/outsert assembly with more relaxed tolerances in the stack-up between the arrowhead and the arrow shaft. What is also needed is an insert outsert assembly that facilitates easy exchange of parts in a field situation. What is also needed is an insert/outsert assembly that is more robust than prior art assemblies. What is also needed is an insert/outsert assembly that remains assembled when the arrowhead is removed from the assembly.

Example assemblies for fixing an arrow tip to an arrow shaft are disclosed. An example assembly includes an insert and a sleeve. The insert has a first end and a second end. The first end of the insert is configured to be inserted into an end of the arrow shaft, and the second end of the insert is configured to receive a securing/anchoring end of the arrow tip. The sleeve is configured to surround at least a portion of the end of the arrow shaft and at least a portion of the insert. The insert includes an engagement mechanism, and the sleeve includes a complementary engagement mechanism. The engagement mechanism and the complementary engagement mechanism are configured to selectively engage one another.

In a particular non-limiting example, the second end of the insert defines a hollow cylindrical shell that has an internal surface and an external surface. The internal surface is configured to receive the end of the arrow tip (e.g., threaded, twist lock, etc.), and the external surface includes the engagement mechanism. The sleeve includes a cylindrical body having a first end, a second end, and an exterior surface. The cylindrical body defines an axial bore that passes through the first end and the second end of the cylindrical body. The axial bore is configured to fit around at least a portion of the end of the arrow shaft at the first end of the cylindrical body and to fit around the second end of the insert at the second end of the cylindrical body. The axial bore additionally defines the complementary engagement mechanism.

In an even more particular example, the engagement mechanism includes a first thread set, the complementary engagement mechanism includes a second thread set, which is configured to engage the first thread set. The axial alignment of the arrow tip and the arrow shaft is independent of a tolerance of engagement of the sleeve with the insert. In addition, the sleeve remains securely engaged with the insert, even without the arrow tip being coupled to the second end of the insert. Optionally, the insert is monolithic, and the sleeve is monolithic.

Some example embodiments optionally include a shoulder feature. For example, the axial bore can define a shoulder on an inner surface of the sleeve. When the sleeve is rotated about the insert, the engagement of the first thread set and the second thread set moves the shoulder toward the end of the arrow shaft or away from the end of the arrow shaft, depending on the direction of rotation of the sleeve with respect to the insert. Whereby, the shoulder can be urged against the end of the arrow shaft.

Some example embodiments also include a lip feature. The second end of the sleeve can include a circumferential lip extending into the bore. When the sleeve is rotated about the insert, the engagement of the first thread set and the second thread set moves the lip toward the second end of the insert or away from the second end of the insert, depending on the direction of rotation of the sleeve with respect to the insert. Whereby, the lip can be urged against the second end of the insert.

Multiple sleeves of different weights can be provided. For example, an example assembly can include a second sleeve. The original sleeve has a first weight, and the second sleeve has a second weight different than the first weight. The second sleeve is interchangeable with the first sleeve. In addition, the assembly can further include a third sleeve. The third sleeve has a third weight different than the first weight and the second weight. The third sleeve is also interchangeable with the original sleeve and the second sleeve.

In the example embodiments, the axial alignment of the arrow tip and the arrow shaft is independent of a tolerance of engagement of the sleeve with the insert. In addition, the sleeve remains securely engaged with the insert without the arrow tip being coupled to the second end of the insert. Optionally, the insert and/or the sleeve can be monolithic, and/or the sleeve can be directly connected to the insert.

Means for selectively, mechanically engaging a sleeve with an insert are disclosed. An example assembly for fixing an arrow tip to an arrow shaft includes an insert and a sleeve. The insert has a first end and a second end. The first end of the insert is configured to be inserted into (or otherwise fixed to) an end of the arrow shaft, and the second end of the insert is configured to receive an end (e.g., a threaded end) of the arrow tip. The sleeve is configured to surround at least a portion of the end of the arrow shaft and at least a portion of the insert. Means for selectively, mechanically engaging the sleeve with the insert are provided between the insert and the sleeve.

Example methods of manufacturing an assembly for fixing an arrow tip to an arrow shaft are also disclosed. One example method includes providing an insert having a first end and a second end, configuring the first end of the insert to be inserted into an end of the arrow shaft, and configuring the second end of the insert to receive an end of the arrow tip. The example method additionally includes forming an engagement mechanism on an outer surface of the insert. The method also includes providing a sleeve configured to surround at least a portion of the end of the arrow shaft and at least a portion of the insert, and forming a complementary engagement mechanism on an inner surface of the sleeve. The complementary engagement mechanism is configured to selectively engage the engagement mechanism of the insert. Optionally, the engagement mechanism can include a first thread set, and the complementary engagement mechanism includes a second thread set configured to engage the first thread set. As another option, the insert and/or the sleeve can be monolithic.

Another example method further includes providing an additional plurality of sleeves. Each additional sleeve is interchangeable with the original sleeve and has a weight different from a respective weight of each of the other sleeves of the additional plurality of sleeves and from a weight of the original sleeve.

BRIEF DESCRIPTION OF THE DRAWINGS

The present invention is described with reference to the following drawings, wherein like reference numbers denote substantially similar elements.

DETAILED DESCRIPTION

The present invention overcomes the problems associated with the prior art, by providing an insert/outsert assembly having a reduced number of tolerances in the tolerance stack-up between an arrowhead and an arrow shaft. In the following description, numerous specific details are set forth (e.g., materials, weight, etc.) in order to provide a thorough understanding of the invention. Those skilled in the art will recognize, however, that the invention may be practiced apart from these specific details. In other instances, details of well-known machining practices (e.g., turning, thread cutting, adhesives, etc.) and components have been omitted, so as not to unnecessarily obscure the present invention.

Figure 1:
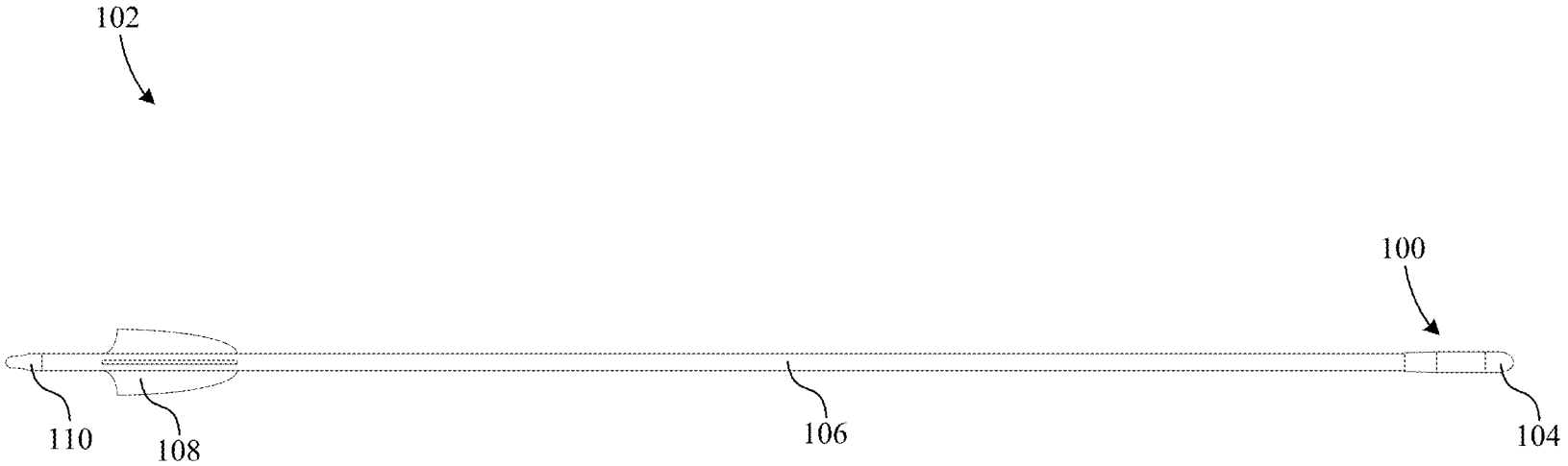
FIG. 1 is a side view of an example arrow assembly.

FIG. 1 shows a side view of an insert/outsert assembly 100 mounted to the end of an arrow 102. Insert/outsert assembly 100 is fixed to the front end of arrow 102 to facilitate the removable coupling of an arrowhead 104 to arrow 102. Insert/outsert assembly 100 also facilitates the removal of arrow 102 from a target (e.g., the tapered contour of the assembly reduces the rear-facing edge). In this example, arrow 102 further includes a small-diameter shaft 106, a set of fletchings 108, and a nock 110.

Figure 2:
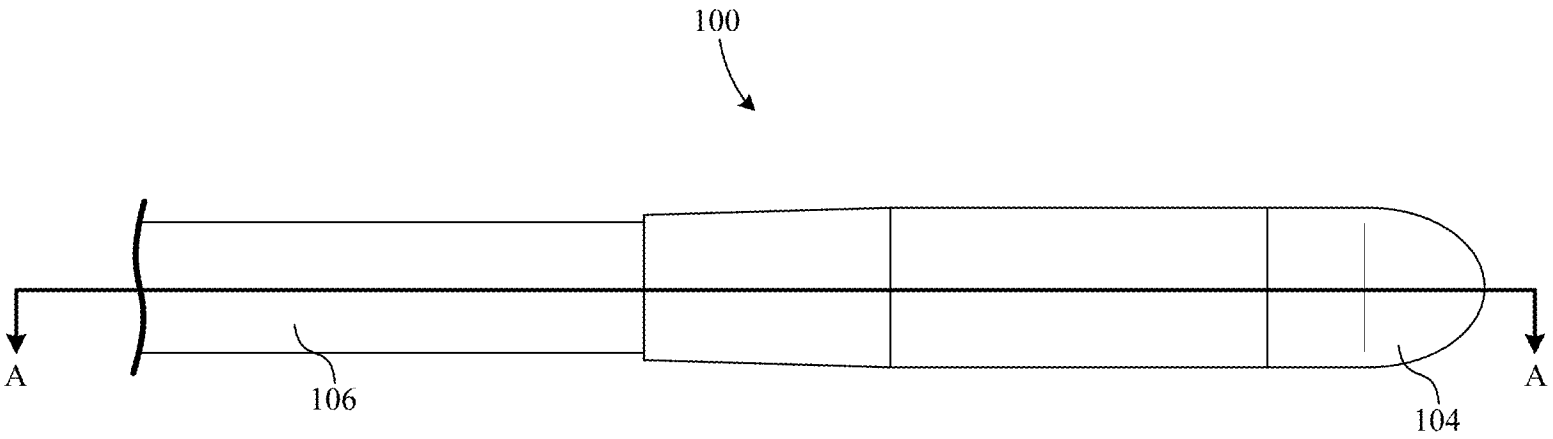
FIG. 2 is a side view of an insert/outsert assembly of the arrow of FIG. 1.

FIG. 2 is close-up view of insert/outsert assembly 100 mounted to the front end of shaft 106. In the example embodiment, arrowhead 104 is a target head. However, those skilled in the art will recognize that arrowhead 104 can be unscrewed from insert/outsert assembly 100 and replaced with any screw-in type arrowhead. As shown, the outer diameter of insert/outsert assembly 100 is greater than the outer diameter of shaft 106, but gradually reduces and is smaller at the rear end of assembly 100.

Figure 3:
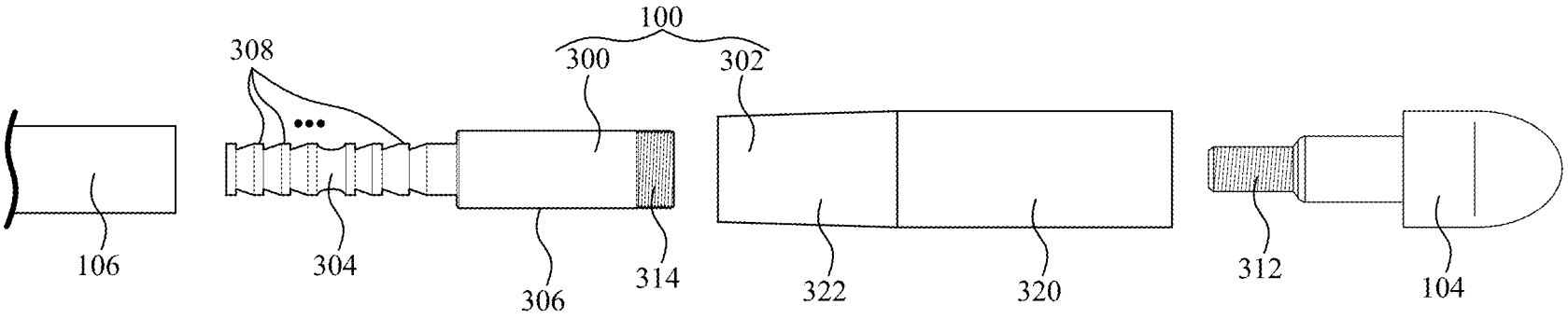
FIG. 3 is an exploded side view of the insert/outsert assembly of FIG. 1.

FIG. 3 is a side view of insert/outsert assembly 100 exploded from shaft 106. In this example embodiment, insert/outsert assembly 100 includes a monolithic metal insert 300 and a monolithic metal outsert 302. In this example embodiment, insert 300 can be formed from 416 stainless steel or 7075 aluminum with a hardened finish, and outsert 302 is machined out of billet of 7075 aluminum. However, any other suitable material(s) can be used to manufacture insert 300 and/or outsert 302.

Insert 300 facilitates the mounting of arrowhead 104 to shaft 106 and includes a first end 304 and a second end 306. First end 304 is configured to be inserted into the open end and adhered to the interior of the front end of shaft 106 by, for example, friction fit and/or epoxy or the like. First end 304 defines a plurality of barb features 308 formed thereon to prevent insert 300 from being pulled out of shaft 106 when arrow 102 is pulled from a target. Second end 306 is configured to receive arrowhead 104 and is configured to receive outsert 302. More specifically, second end 306 includes a hollow, cylindrical shell that defines an interior threaded bore 310 (shown in FIG. 4) and a smooth bore 311 (FIG. 4), which are configured to receive a complimentary thread set 312 and a smooth shank 313 of arrowhead 104, respectivley. Furthermore, second end 306 includes an external thread set 314 on an exterior surface of insert 300, which is configured to thread into a complimentary thread set 316 (shown in FIG. 4) formed on an interior bore 318 (also shown in FIG. 4) passing through outsert 302.

Outsert 302 is essentially a collar or sleeve that facilitates the removal of arrow 102 from a target and also provides structural reinforcement between insert/outsert assembly 100 and shaft 106. In addition to thread set 316 of interior bore 318, outsert 302 also includes a cylindrical exterior surface having a front region 320 and a rear region 322. In the example embodiment, the outer diameter of front region 320 is substantially identical to the outer diameter of arrowhead 104. This prevents damage to the target when arrow 102 impacts the target and/or is removed from the target. The outer diameter of rear region 322 is tapered down to provide a smooth surface transition between front region 320 and the exterior surface of shaft 106. As previously mentioned, the tapered aspect of rear region 322 facilitates the extraction of arrow 102 from a target without destroying the target and/or pulling insert 300 from shaft 106.

In addition to providing additional rigidity between shaft 106 and insert 300, outsert 302 remains engaged with insert 300, even when arrowhead 104 is removed from insert 300. The engagement of threads 314 and 316 allow a lip at the front end 402 (FIG. 4) to be urged against insert 300 when outsert 302 is rotated with respect to insert 300. When the lip urges against insert 300, the frictional force between threads 314 and 316 is increased, thereby preventing unintended rotation and/or loosening of outsert 302 with respect to insert 300. This provides a substantial advantage, because it reduces the risk and inconvenience of outsert 302 falling off when changing arrowhead 104. This advantage is even more valuable in field situations, where it is much more likely that a dropped insert would become lost.

Figure 4:
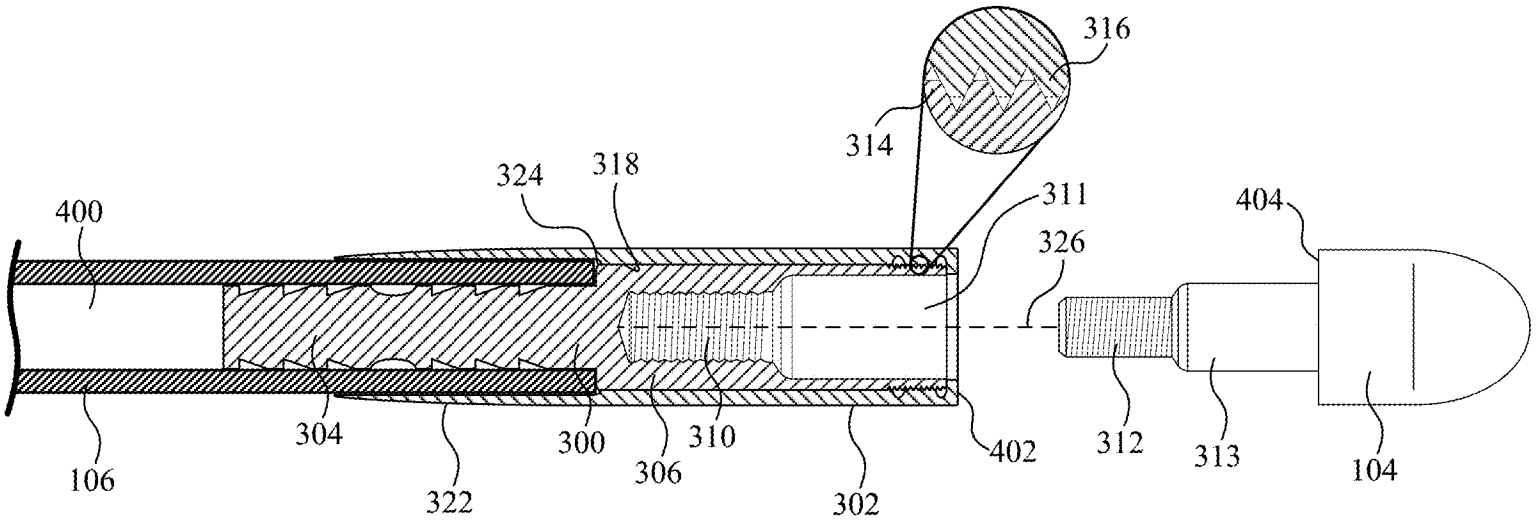
FIG. 4 is a cross-sectional side view of the insert/outsert assembly of FIG. 1.

FIG. 4 shows a cross-sectional view of insert/outsert assembly 100 and shaft 106 taken along line A-A of FIG. 2. The inner surface of outsert 302 defines a shoulder 324 that can be urged against the end of arrow shaft 106, to provide some compression of outsert 302 and additional rigidity to assembly 100. Rotating outsert 302 with respect to insert 300 with threads 314 and 316 engaged will cause shoulder 324 to move toward or away from the end of shaft 106, depending on the direction of rotation. After bringing shoulder 324 into contact with the end of arrow shaft 106, additional rotation of outsert 302 will selectively increase the force between shoulder 324 and shaft 106.

In addition, the threaded engagement of insert 300 and outsert 302 can also facilitate the tuning of the orientation of an alternative arrowhead (e.g., a mulit-blade broadhead) with the orientation of fletchings 108. For example, after a broadhead arrow is fully screwed into insert 300, the blades of the broadhead might not be oriented properly with fletchings 108. In that case, the broadhead can be backed out slightly to achieve the proper orientation of the broadhead blades, then outsert 302 can be backed off slightly to take up any slack in the threaded connection between the broadhead and insert 300.

As illustrated by the previous examples, the adjustability of the position of outsert 302 along axis 326 provides multiple advantages. The coupling of outsert 302 to insert 300 via threads 314 and 316 provides the desired adjustability.

The structure of insert 300 also provides significant advantages. In particular, second end 306 of insert 300 includes threaded bore 310 and smooth bore 311 formed in the same unitary insert 300. As explained above, threaded bore 310 receives thread set 312 of arrowhead 104. In addition, smooth bore 311 has a larger diameter than threaded bore 310, to closely receive almost the entirety of shank 313 of arrowhead 104. Receiving both the threaded end and the larger shank 313 within unitary insert 300 substantially increases the strength of the attachment of arrowhead 104 to arrow shaft 106. Indeed, the strength of the connection is increased sufficiently that arrow 100 could be safely fired into a target without outsert 302. In contrast, in prior art devices, where an insert receives only the threaded end of an arrow head, impact with a target would cause the point end of the arrowhead to snap off of the threaded end.

The assembly of insert/outsert assembly 100, arrowhead 104, and shaft 106 will now be summarized. First, adhesive (e.g. an epoxy) is applied to first end 304 of insert 300. First end 304 is then inserted into interior space 400 of shaft 106 and pressed in until second end 306 engages the planar front end of shaft 106. Once the adhesive cures, outsert 302 is screwed onto insert 300 such that thread sets 314 and 316 engage one another. At this point, the interior of rear region 322 of outsert 302 fits against the outer surface of shaft 106 to provide additional structural support between insert/outsert assembly 100 and shaft 106. Finally, arrowhead 104 is screwed into insert 300 through the front opening of outsert 302 until the front end 402 of outsert 302 frictionally engages the rear planar surface 404 of arrowhead 104.

As previously mentioned, the coaxial mounting of the arrowhead with respect to the shaft is essential for optimal arrow flight. Of course, in reality this can only be done within a realistic overall tolerance that is dictated by the tolerance stack-up between the arrow shaft and the arrowhead. In the prior art, the tolerance stack-up includes three tolerances: the alignment tolerance between the insert and the interior of the arrow shaft; the alignment tolerance between the outsert and the insert; and the alignment tolerance between the arrowhead and the outsert. In the present invention however, the tolerance stack-up includes only two tolerances: the alignment tolerance between first end 304 of insert 300 and the interior of shaft 106; and the alignment tolerance between arrowhead 104 and insert 300. By eliminating one alignment tolerance (outsert with respect to insert) from the stack-up, the present invention is able to achieve a much higher degree of accuracy in terms of coaxial alignment between arrowhead 104 and shaft 106. In addition to achieving improved alignment, the relaxed tolerances also provide for simpler manufacturing of insert/outsert assembly 100 as compared to the prior art. Unlike the prior art, the alignment of arrowhead 104 with respect to insert 300 does not depend on the alignment of the outsert with respect to the insert.

Figure 5:
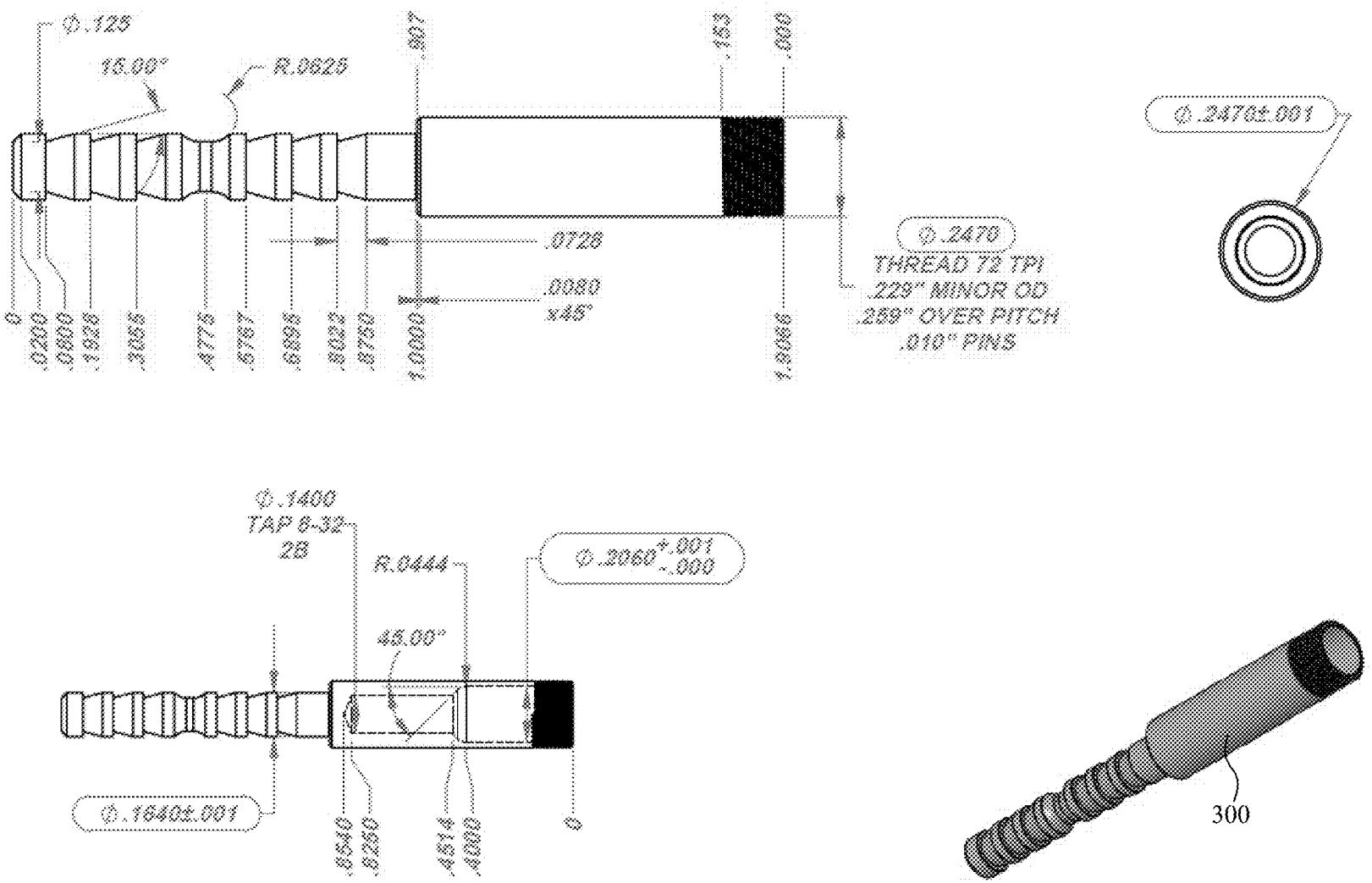
FIG. 5 shows specific dimensions of the insert of FIG. 3.

FIG. 5 shows a blueprint of insert 300 according to one embodiment of the present invention.

Figure 6:
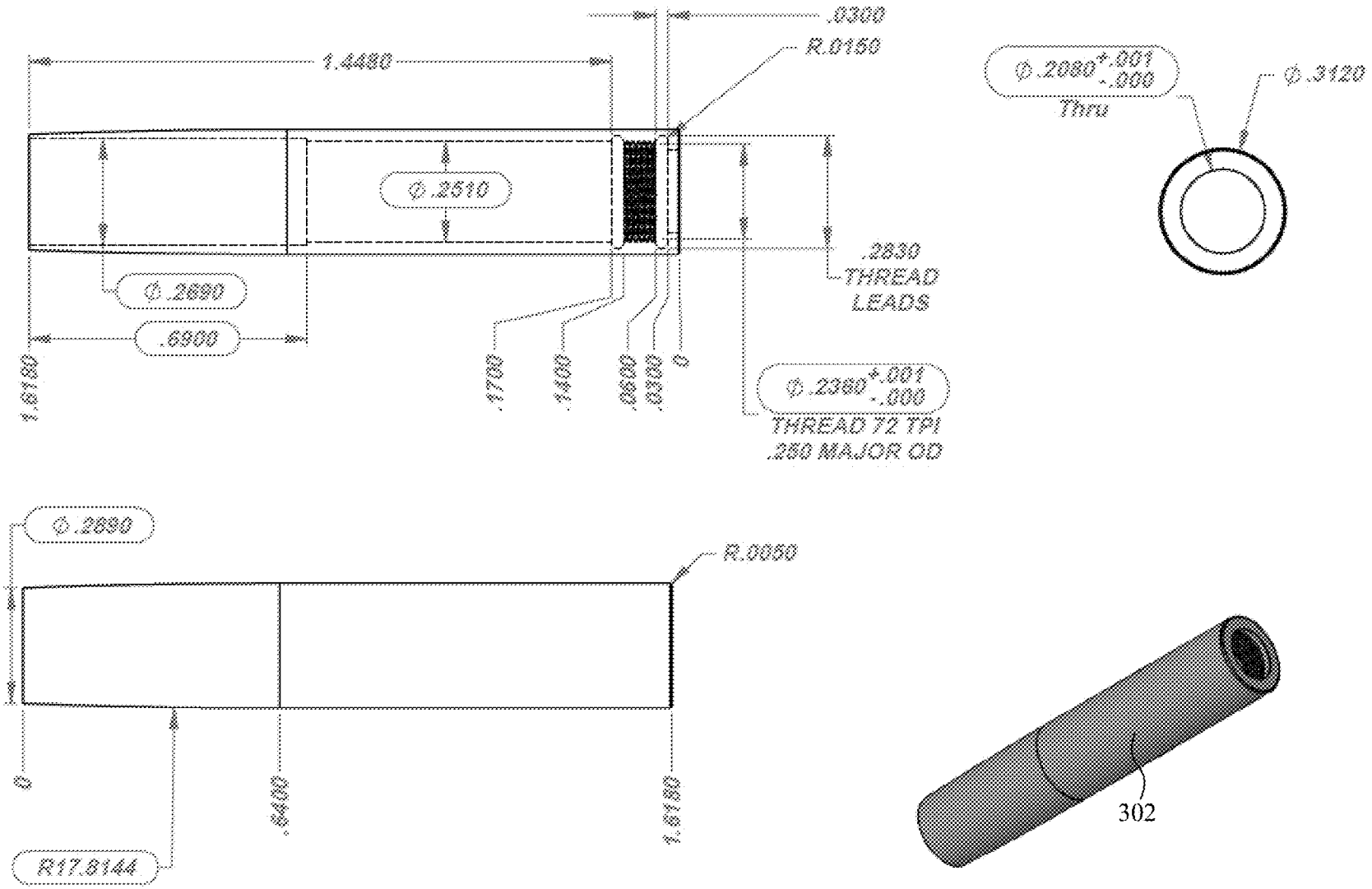
FIG. 6 shows specific dimensions of the outsert of FIG. 3.

FIG. 6 shows specific dimensions of outsert 302 according to a non-limiting example embodiment of the present invention.

Figure 7:
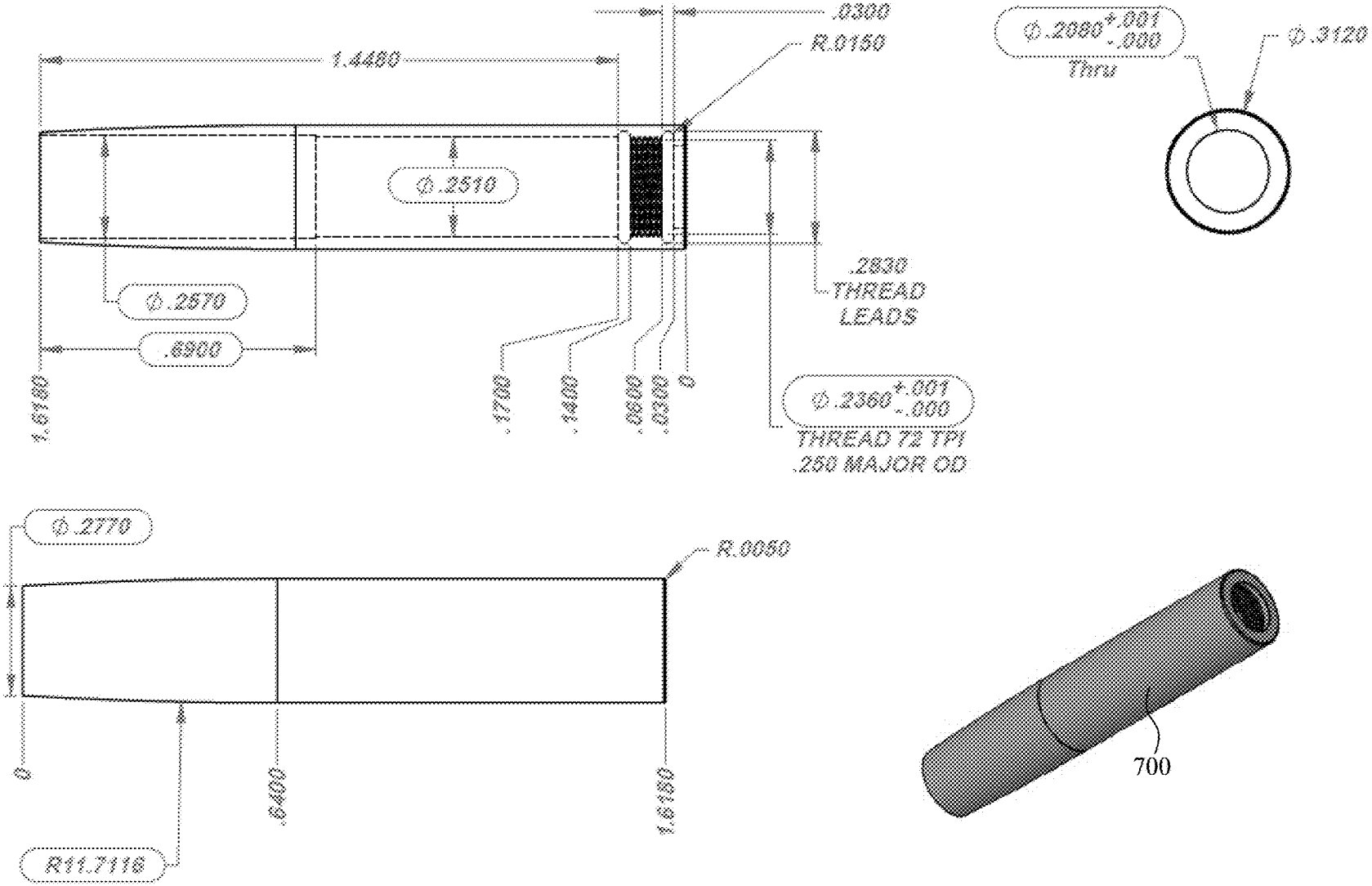
FIG. 7 shows specific dimensions of an alternate outsert.

FIG. 7 shows specific dimensions of another example outsert 700. Outsert 700 is similar to outsert 302, except that outsert 700 is made slightly heavier (e.g., by adjusting the contour and/or dimensions of outsert 700 to include more of the same material, by using different material, etc.) than outsert 302, to accommodate for archer preference and/or achieve improved flight stability. Thus, the weight of insert/outsert assembly 100 can be increased simply by replacing outsert 302 with outsert 700, without ever having to remove insert 300 from shaft 106.

Figure 8:
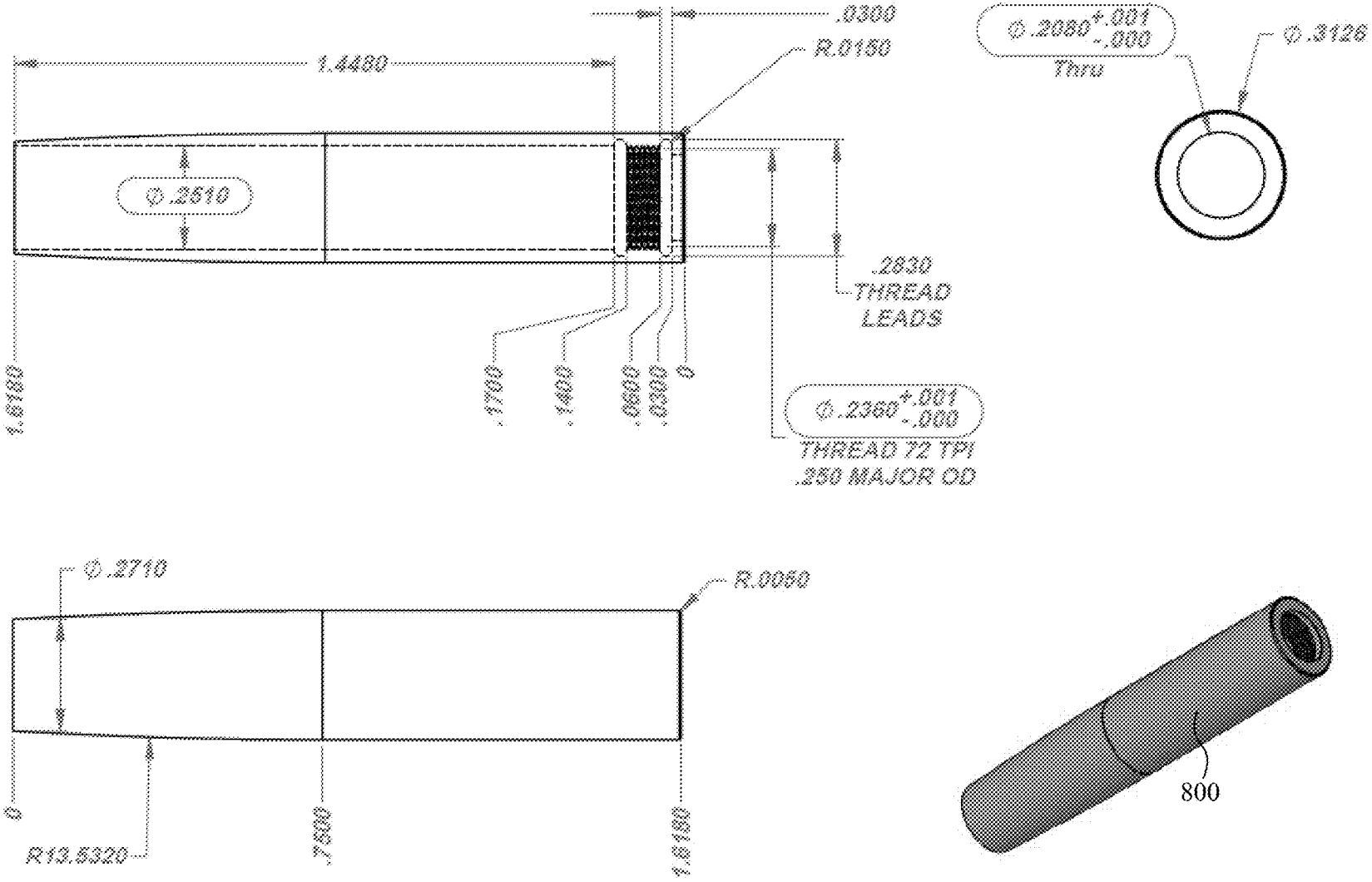
FIG. 8 shows specific dimensions of another alternate outsert.

FIG. 8 shows specific dimensions of another example outsert 800. Outsert 800 is similar to outserts 302 and 700, except that outsert 800 is made slightly heavier than outsert 700. So, the weight of insert/outsert assembly 100 can be further increased simply by replacing outsert 700 with outsert 800, without ever having to remove insert 300 from shaft 106.

In general, any number of differently weighted outserts, each configured to removably couple to insert 300, can be provided in combination with insert 300, to facilitate the selective adjustment of the weight of insert/outsert assembly 100. The mechanical coupling (e.g., a thread set) facilitates the selective removal/replacement of the outserts, which provides an important advantage over prior art collars which may be permanently adhered (e.g., glued, pressed, etc.) to the insert.

Figure 9:
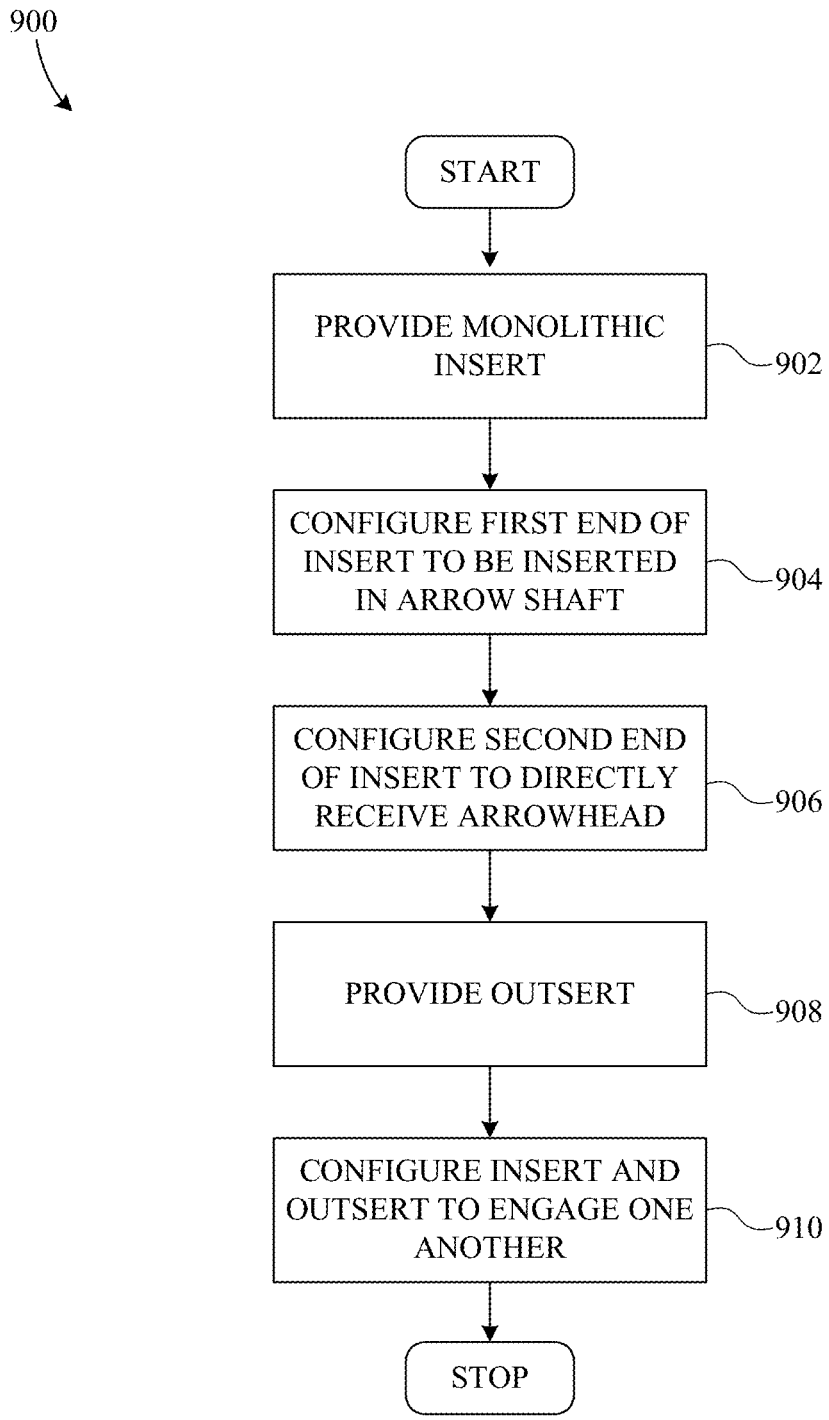
FIG. 9 is a flowchart summarizing a method of manufacturing an insert/outsert assembly.

FIG. 9 is a flowchart 900 summarizing a method of manufacturing an insert/outsert assembly. In a first step 902, a monolithic insert is provided. Then, in a second step 904, a first end of the insert is configured to be inserted into an arrow shaft. Next, in a third step 906, a second end of the insert is configured to directly receive an arrowhead. Then, in a fourth step 908, an outsert is provided. Finally, in a fifth step 910, the insert and the outsert are configured to engage one another.

The description of particular embodiments of the present invention is now complete. Many of the described features may be substituted, altered or omitted without departing from the scope of the invention. For example, alternate arrow engaging features (e.g., knurling, ridges, channels, etc.), may be substituted for the barbs of the insert. As another example, alternate metals (or other materials) and dimensions may be used to achieve different weight and strength characteristics for the insert/outsert assembly. As yet another example, alternate engagement and/or complementary engagement mechanisms (e.g., twist-lock, cam-lock, etc.) can be substituted for the complementary thread set disclosed. These and other deviations from the particular embodiments shown will be apparent to those skilled in the art, particularly in view of the foregoing disclosure.

I claim:

1. An assembly for fixing an arrow tip to an arrow shaft, said assembly comprising:

an insert having a first end and a second end, said first end of said insert being configured to be inserted into an end of said arrow shaft, and said second end of said insert being configured to receive an end of said arrow tip, said insert additionally including an engagement mechanism;

a sleeve configured to surround at least a portion of said end of said arrow shaft and at least a portion of said insert, said sleeve including a complementary engagement mechanism configured to selectively engage said engagement mechanism of said insert; and wherein said second end of said insert defines a hollow cylindrical shell having an internal surface and an external surface, said internal surface being configured to receive said end of said arrow tip, said external surface including said engagement mechanism;

said sleeve includes a cylindrical body having a first end, a second end, and an exterior surface, said cylindrical body defining an axial bore passing through said first end and said second end, said axial bore being configured to fit around at least a portion of said end of said arrow shaft at said first end of said cylindrical body and to fit around said second end of said insert at said second end of said cylindrical body, said axial bore additionally defining said complementary engagement mechanism;

said engagement mechanism includes a first thread set;

said complementary engagement mechanism includes a second thread set configured to engage said first thread set;

said second end of said sleeve includes a circumferential lip extending into said bore; and when said sleeve is rotated about said insert, the engagement of said first thread set and said second thread set moves said lip toward said second end of said insert or away from said second end of said insert, depending on the direction of rotation of said sleeve with respect to said insert, whereby said lip can be urged against said second end of said insert.

2. The assembly of claim 1, wherein the axial alignment of said arrow tip and said arrow shaft is independent of a tolerance of engagement of said sleeve with said insert.

3. The assembly of claim 2, wherein said sleeve remains securely engaged with said insert without said arrow tip being coupled to said second end of said insert.

4. The assembly of claim 3, wherein:

said insert is monolithic; and said sleeve is monolithic.

5. The assembly of claim 1, wherein:

said axial bore defines a shoulder on an inner surface of said sleeve; and when said sleeve is rotated about said insert, the engagement of said first thread set and said second thread set moves said shoulder toward said end of said arrow shaft or away from said end of said arrow shaft, depending on the direction of rotation of said sleeve with respect to said insert, whereby said shoulder can be urged against said end of said arrow shaft.

6. The assembly of claim 1, wherein said hollow cylindrical shell of said second end of said insert includes:

a first section including a first axial bore, said first axial bore having a first diameter and including a thread set configured to engage a complementary thread set of said end of said arrow tip; and a second section including a second axial bore, said second axial bore having a second diameter larger than said first diameter of said first axial bore, said second axial bore additionally including a smooth wall configured to closely receive a smooth shank of said arrow tip.

7. The assembly of claim 1, further comprising a second sleeve, and wherein:

said sleeve has a first weight;

said second sleeve has a second weight different than said first weight; and said second sleeve is interchangeable with said sleeve.

8. The assembly of claim 7, further comprising a third sleeve, and wherein:

said third sleeve has a third weight different than said first weight and said second weight; and said third sleeve is interchangeable with said sleeve and said second sleeve.

9. The assembly of claim 1, wherein said sleeve remains securely engaged with said insert without said arrow tip being coupled to said second end of said insert.

10. The assembly of claim 1, wherein said insert is monolithic.

11. The assembly of claim 1, wherein said sleeve is monolithic.

12. The assembly of claim 1, wherein said sleeve is directly connected to said insert.

13. A method of manufacturing an assembly for fixing an arrow tip to an arrow shaft, said method comprising:

providing an insert having a first end and a second end;

configuring said first end of said insert to be inserted into an end of said arrow shaft;

configuring said second end of said insert to receive an end of said arrow tip;

forming an engagement mechanism on an outer surface of said insert;

providing a sleeve configured to surround at least a portion of said end of said arrow shaft and at least a portion of said insert;

forming a complementary engagement mechanism on an inner surface of said sleeve, said complementary engagement mechanism being configured to selectively engage said engagement mechanism of said insert; and providing an additional plurality of sleeves, each additional sleeve being interchangeable with said sleeve and having a weight different from a respective weight of each other of said additional plurality of sleeves and from a weight of said sleeve.

14. The method of claim 13, wherein:

said engagement mechanism includes a first thread set; and said complementary engagement mechanism includes a second thread set configured to engage said first thread set.

15. An assembly for fixing an arrow tip to an arrow shaft, said assembly comprising:

an insert having a first end and a second end, said first end of said insert being configured to be inserted into an end of said arrow shaft, and said second end of said insert being configured to receive an end of said arrow tip, said insert additionally including an engagement mechanism; and a sleeve configured to surround at least a portion of said end of said arrow shaft and at least a portion of said insert, said sleeve including a complementary engagement mechanism configured to selectively engage said engagement mechanism of said insert; and wherein said second end of said insert defines a hollow cylindrical shell having an internal surface and an external surface, said internal surface being configured to receive said end of said arrow tip, said external surface including said engagement mechanism;

said sleeve includes a cylindrical body having a first end, a second end, and an exterior surface, said cylindrical body defining an axial bore passing through said first end and said second end, said axial bore being configured to fit around at least a portion of said end of said arrow shaft at said first end of said cylindrical body and to fit around said second end of said insert at said second end of said cylindrical body, said axial bore additionally defining said complementary engagement mechanism;

said hollow cylindrical shell of said second end of said insert includes a first section including a first axial bore, said first axial bore having a first diameter and including a thread set configured to engage a complementary thread set of said end of said arrow tip; and said hollow cylindrical shell of said second end of said insert includes a second section including a second axial bore, said second axial bore having a second diameter larger than said first diameter of said first axial bore, said second axial bore additionally including a smooth wall configured to closely receive a smooth shank of said arrow tip.

16. The assembly of claim 15, wherein:

said engagement mechanism includes a thread set; and said complementary engagement mechanism includes a complimentary thread set configured to engage said thread set of said engagement mechanism.

17. The assembly of claim 16, wherein the axial alignment of said arrow tip and said arrow shaft is independent of a tolerance of engagement of said sleeve with said insert.

18. The assembly of claim 17, wherein said sleeve remains securely engaged with said insert without said arrow tip being coupled to said second end of said insert.

19. The assembly of claim 18, wherein:

said insert is monolithic; and said sleeve is monolithic.

20. The assembly of claim 16, wherein:

said axial bore defines a shoulder on an inner surface of said sleeve; and when said sleeve is rotated about said insert, the engagement of said thread set of said engagement mechanism and said thread set of said complimentary engagement mechanism moves said shoulder toward said end of said arrow shaft or away from said end of said arrow shaft, depending on the direction of rotation of said sleeve with respect to said insert, whereby said shoulder can be urged against said end of said arrow shaft.

21. The assembly of claim 15, further comprising a second sleeve, and wherein:

said sleeve has a first weight;

said second sleeve has a second weight different than said first weight; and said second sleeve is interchangeable with said sleeve.

22. The assembly of claim 21, further comprising a third sleeve, and wherein:

said third sleeve has a third weight different than said first weight and said second weight; and said third sleeve is interchangeable with said sleeve and said second sleeve.

23. The assembly of claim 15, wherein the axial alignment of said arrow tip and said arrow shaft is independent of a tolerance of engagement of said sleeve with said insert.

24. The assembly of claim 15, wherein said sleeve remains securely engaged with said insert without said arrow tip being coupled to said second end of said insert.

25. The assembly of claim 15, wherein said insert is monolithic.

26. The assembly of claim 15, wherein said sleeve is monolithic.

27. The assembly of claim 15, wherein said sleeve is directly connected to said insert.

28. An assembly for fixing an arrow tip to an arrow shaft, said assembly comprising:

an insert having a first end and a second end, said first end of said insert being configured to be inserted into an end of said arrow shaft, and said second end of said insert being configured to receive an end of said arrow tip, said insert additionally including an engagement mechanism; and a sleeve configured to surround at least a portion of said end of said arrow shaft and at least a portion of said insert, said sleeve including a complementary engagement mechanism configured to selectively engage said engagement mechanism of said insert;

a second sleeve; and wherein said sleeve has a first weight;

said second sleeve has a second weight different than said first weight; and said second sleeve is interchangeable with said sleeve.

29. The assembly of claim 28, wherein:

said second end of said insert defines a hollow cylindrical shell having an internal surface and an external surface, said internal surface being configured to receive said end of said arrow tip, said external surface including said engagement mechanism; and said sleeve includes a cylindrical body having a first end, a second end, and an exterior surface, said cylindrical body defining an axial bore passing through said first end and said second end, said axial bore being configured to fit around at least a portion of said end of said arrow shaft at said first end of said cylindrical body and to fit around said second end of said insert at said second end of said cylindrical body, said axial bore additionally defining said complementary engagement mechanism.

30. The assembly of claim 29, wherein:

said engagement mechanism includes a first thread set; and said complementary engagement mechanism includes a second thread set configured to engage said first thread set.

31. The assembly of claim 30, wherein the axial alignment of said arrow tip and said arrow shaft is independent of a tolerance of engagement of said sleeve with said insert.

32. The assembly of claim 31, wherein said sleeve remains securely engaged with said insert without said arrow tip being coupled to said second end of said insert.

33. The assembly of claim 32, wherein:

said insert is monolithic; and said sleeve is monolithic.

34. The assembly of claim 30, wherein:

said axial bore defines a shoulder on an inner surface of said sleeve; and when said sleeve is rotated about said insert, the engagement of said first thread set and said second thread set moves said shoulder toward said end of said arrow shaft or away from said end of said arrow shaft, depending on the direction of rotation of said sleeve with respect to said insert, whereby said shoulder can be urged against said end of said arrow shaft.

35. The assembly of claim 28, further comprising a third sleeve, and wherein:

said third sleeve has a third weight different than said first weight and said second weight; and said third sleeve is interchangeable with said sleeve and said second sleeve.

36. The assembly of claim 28, wherein the axial alignment of said arrow tip and said arrow shaft is independent of a tolerance of engagement of said sleeve with said insert.

37. The assembly of claim 28, wherein said sleeve remains securely engaged with said insert without said arrow tip being coupled to said second end of said insert.

38. The assembly of claim 28, wherein said insert is monolithic.

39. The assembly of claim 28, wherein said sleeve is monolithic.

40. The assembly of claim 28, wherein said sleeve is directly connected to said insert.

* * * * *